United States Patent [19]

Lorek et al.

[11] 4,453,674

[45] Jun. 12, 1984

[54] NOZZLE FOR A BURNER OPERATING ON LIQUEFIED PETROLEUM GAS

[75] Inventors: Georges Lorek, St. Aubin les Elboeuf; Joel C. F. Blondet, Barneville sur Seine, both of France

[73] Assignee: Shell Oil Company, Houston, Tex.

[21] Appl. No.: 373,074

[22] Filed: Apr. 29, 1982

[30] Foreign Application Priority Data

May 11, 1981 [FR] France ..... 81 09325

[51] Int. Cl.[3] ..... B05B 1/34

[52] U.S. Cl. ..... 239/483; 239/583

[58] Field of Search ..... 239/463, 476, 482, 485, 239/582, 583, 483

[56] References Cited

U.S. PATENT DOCUMENTS

| | | | |
|---|---|---|---|
| 2,527,891 | 10/1950 | Pulver et al. | 239/476 |
| 3,433,420 | 3/1969 | Strout | 239/476 |

FOREIGN PATENT DOCUMENTS

| | | | |
|---|---|---|---|
| 12837 | of 1909 | United Kingdom | 239/582 |
| 200531 | 7/1923 | United Kingdom . | |
| 525725 | 9/1940 | United Kingdom . | |
| 629636 | 9/1949 | United Kingdom | 239/463 |
| 907258 | 10/1962 | United Kingdom . | |
| 1313714 | 4/1973 | United Kingdom . | |
| 1470820 | 4/1977 | United Kingdom . | |

*Primary Examiner*—John J. Love
*Assistant Examiner*—Mary F. McCarthy

[57] ABSTRACT

A burner operating on liquefied petroleum gas comprising a tubular barrel having an inlet for the liquefied petroleum gas. The end of the tubular barrel is provided with a swirl chamber that debouches into a calibrated central injector port. A cylindro-ogival end piece is attached to the end of the barrel and the axial position of the end piece with respect to the injector port is varied to vary the flow rate of the burner.

2 Claims, 1 Drawing Figure

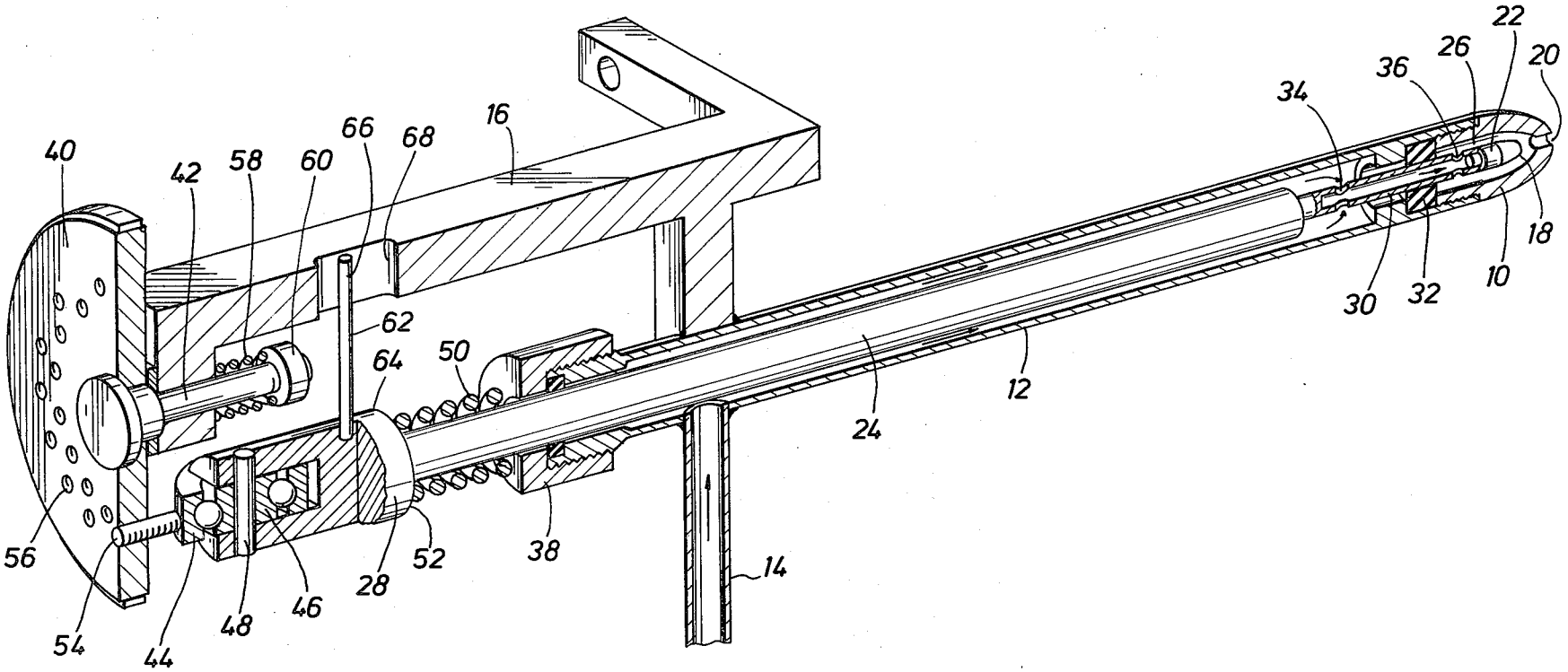
20
22
26
36
34
18
10
32
30
12
24
14
16
38
50
52
28
68
66
62
64
60
58
42
40
46
48
44
54
56

NOZZLE FOR A BURNER OPERATING ON LIQUEFIED PETROLEUM GAS

BACKGROUND OF THE INVENTION

The present invention relates to a nozzle for a burner operating on liquefied petroleum gas, in particular liquid butane.

Nozzles of this type are known in the prior art, which comprise a tubular body provided with a liquefied petroleum gas feed connector and an inner swirl chamber debouching outwardly through a calibrated injector port, and also a cylindro-ogival piece having a conical extremity provided with tangential channels and arranged inside the swirl chamber. These nozzles are designed to be placed in a combustion chamber in such a way as to provide an annular passage for an oxygen-containing gas, such as air, to ensure combustion of the liquefied gas at the outlet of the calibrated injector port of the nozzle. In known nozzles of this type, the cylindro-ogival piece is held in a fixed manner inside the body of the nozzle by means of a suitable element such as a locking screw. In such nozzles, the pressurized liquefied gas passes along the cylindro-ogival piece where it follows the tangential channels. The channels give it a rotating motion as it debouches into the swirl chamber. The function of said chamber is to increase and standardize the swirling speed of the liquefied gas before its discharge through the calibrated port. The liquefied gas, upon being abruptly released at the outlet of the calibrated port, is transformed into a cloud in the shape of a swirling cone. These known nozzles have characteristics (flow rate and vaporization angle) that are well-defined and invariable.

SUMMARY OF THE INVENTION

The objective of the present invention is to improve the known nozzles of this type so as to allow their flow rate to be varied. To that end the present invention proposes that the nozzle should comprise means to adjust the position of the cylindro-ogival piece in relation to the calibrated port along the axis of the latter. By varying the position of the cylindro-ogival piece, it is possible to vary, in a progressive and continuous manner, the flow rate of the nozzle, and within the limit of correct vaporization, a different value of the diameter of the calibrated port allows the modulation range of the flow rate to be varied.

As a result, the minimum flow rate of a nozzle according to the invention corresponds to the section of the tangential channels when the cylindro-ogival piece is applied against the swirl chamber. The maximum flow rate depends on the diameter of the calibrated port and is only obtained when the cylindro-ogival piece is retracted in relation to the outlet port.

According to another characteristic of the invention, the adjustment means comprise a control rod arranged inside the tubular body so as to provide an annular passage for the liquefied petroleum gas, the control rod having a first extremity connected in a cooperating manner with a control means. The control means conveniently comprise a variable-profile circular cam rotatably mounted on a shaft parallel to the control rod, said cam co-operating with a roller mounted freely and transversely on the second extremity of the control rod, a spring being provided to force the roller elastically back towards the cam.

The nozzle of the invention conveniently comprises a safety spring linked to the shaft of the circular cam in order to exert an axial elastic pull on the circular cam towards the roller. Said spring serves to take up wear, but also to limit the pressure of the cylindro-ogival piece against the swirl chamber of the nozzle in order to avoid any deterioration that might cause an accidental thrust.

In a preferred embodiment of the invention, the circular cam is formed by a disc of which the profile is formed by a plurality of adjustable screws which pass through the thickness of the disc and are arranged in parallel and concentrically with the shaft of the disc. In a preferred embodiment of the invention, the control rod comprises, near the first extremity, a hollow part which slides inside a sealing ring and which contains through-ports to allow liquefied petroleum gas to pass from the annular passage to the hollow part and then from said hollow part to the swirl chamber.

BRIEF DESCRIPTION OF THE DRAWING

Other characteristics and advantages of the invention will be more readily understood from the following detailed description, which is given with reference to the appended drawing, where:

The FIGURE shows a perspective view in axial section of a nozzle according to the invention, mounted on its support.

DESCRIPTION OF A PREFERRED EMBODIMENT

The appended FIGURE shows a nozzle for a burner operating on liquefied petroleum gas in accordance with the invention. The nozzle comprises a substantially tubular body 10 screwed on to the extremity of a sleeve 12 fitted with a lateral liquefied petroleum gas feed connector 14. This assembly is fixed on a support 16. The body 10 is provided with an interior swirl chamber 18 which debouches outwardly through a calibrated injector port 20. Inside the swirl chamber 18 a cylindro-ogival piece 22 is provided which has a conical extremity provided with tangential channels suitable to impart a rotating motion to the liquefied petroleum gas before the gas debouches into the swirl chamber 18.

The invention comprises means to adjust the position of said cylindro-ogival piece 22 in relation to the calibrated port 20 along the axis thereof. The adjustment means comprise a control rod 24 arranged inside the body 10 and the sleeve 12 in such a way as to provide an annular passage for the liquefied petroleum gas introduced through the lateral connector 14. The rod 24 comprises a first extremity 26 which is connected to the cylindro-ogival piece 22 and a second extremity 28 which is connected in a co-operating manner to control means which will be described below. Near its first extremity 26 the rod 24 comprises a hollow part 30 having a small diameter, which slides inside a sealing ring 32 that is gripped between the body 10 and the sleeve 12. The sealing ring may be made, for example of polytetrafluoroethylene, and it allows the cylindro-ogival piece 22 to be centered in the axis of the calibrated port 20. The hollow part 30 is provided with through-ports such as ports 34 and tangential ports 36, upstream and downstream, respectively, of the sealing ring 32 in order to allow the liquefied petroleum gas to pass from the annular passage to the hollow part and from said hollow part to the swirl chamber 18.

Near its second extremity 28, the rod 24 slides in a stuffing-box 38 screwed to the extremity of the sleeve 12 opposite the extremity holding body 10. The stuffing-box 38 is intended to ensure sealing of the nozzle at its extremity opposite that comprising the calibrated port.

The aforementioned control means comprise a variable-profile circular cam 40 rotatably mounted on a shaft 42 passing through an appropriate port of the support 16, said shaft being parallel to the control rod 24, this is to say parallel to the axis of the calibrated port 20. The cam 40 co-operates with a loosely mounted roller 44, through the medium of a ballbearing 46 on a shaft 48 which is transversely arranged on a second extremity 28 of the control rod 24. A spring 50 is interposed between a shoulder 52 of the control rod 24 and the stuffing-box 38 in such a manner as to elastically force the roller 44 towards the cam 40.

The cam 40 is formed by a disc and the profile of the cam is formed by a plurality of adjustable screws, such as 54, which pass through the thickness of the disc and which are arranged in parallel and concentrically to the shaft of the disc. Internally threaded holes such as 56, are provided in the disc to enable the screws 54 to be introduced therein. The screws 54 may be screwed down to a greater or lesser degree independently of one another in order to create a variable-profile cam.

The device furthermore includes a safety spring 58 arranged around the shaft 42 of the circular cam in order to exert an axial elastic pull on said cam towards the roller. The spring 58 is interposed between the support 16 and a stop 60 integral with the shaft 42. As explained above, said spring serves to take up wear but also to limit the pressure of the cylindro-ogival piece 22 against the swirl chamber 18.

The device also comprises an anti-rotation rod 62 of which one extremity 64 is radially introduced in the extremity 28 of the control rod 24 and the opposite extremity 66 can slide in an oblong slot 68 of the support 16 arranged parallel to the axis of the rod 24. The rod 62 thereby readily allows axial displacement of the control rod 24 and prevents any rotational movement thereof.

The nozzle of the invention is intended to be positioned at the center of a combustion chamber, providing an annular passage for an oxygen-containing gas, such as air, which is needed for the combustion of the liquefied petroleum gas when it leaves the calibrated port of the nozzle. The combustion gas is conveniently passed to the combustion chamber by means of a fan, for example a centifugal fan, and the flow rate of the combustion gas can be adjusted by an appropriate valve, for example, a gate valve directly coupled to a servomotor. A chain transmission system is conveniently provided so that the operation of said valve varies the flow rate of the liquefied gas from the nozzle in a coordinated manner by acting upon the cam of the nozzle. The nozzle of the invention is intended to be used in burners operating on liquefied petroleum gas, and in particular in burners operating on liquid butane. Such burners have numerous industrial applications, especially in industrial furnaces or boilers.

What is claimed is:

1. A burner for liquefied petroleum gas comprising:

a tubular body having an inlet for the liquefied petroleum gas;

a swirl chamber disposed adjacent one end of the tubular body;

a calibrated injector port, said swirl chamber debouching outwardly through said injector port;

a cylindro-ogival end piece, said cylindro-ogival end piece disposed inside said swirl chamber with its conical end projecting into said swirl chamber;

a control rod member disposed inside of said tubular body and having a tubular portion on one end, said cylindro-ogival end piece being attached to the end of said tubular portion, said tubular portion having ports for passage of the liquefied petroleum gas into the interior of said tubular portion and tangential ports for imparting a rotary motion to the liquefied petroleum gas as it debouches from the tubular portion into said swirl chamber;

a circular cam means, said cam being mounted for rotation about an axis parallel to the axis of said control rod member, and having a variable profile circular cam, the variable profile surface of said cam cooperating with a roller follower mounted on the other end of said control rod; and biasing means disposed to bias said control rod into engagement with said cam, whereby said control rod is moved axially as said cam is rotated.

2. The burner of claim 1 wherein said cam is formed by a disc having a plurality of adjustable rod-like members that have their axes disposed parallel and concentrically with the axis of the cam shaft, said rod-like members engaging the cam follower of said control rod.

* * * * *